US008182276B2

(12) United States Patent
Ruffner

(10) Patent No.: US 8,182,276 B2
(45) Date of Patent: May 22, 2012

(54) MULTI-WAY SLIDING PLUG

(76) Inventor: Walter Ruffner, Jolly Harbour (AG)

( * ) Notice: Subject to any disclaimer, the term of this patent is extended or adjusted under 35 U.S.C. 154(b) by 0 days.

(21) Appl. No.: 12/999,974

(22) PCT Filed: Jun. 16, 2009

(86) PCT No.: PCT/CH2009/000205

§ 371 (c)(1),
(2), (4) Date: Dec. 21, 2010

(87) PCT Pub. No.: WO2009/152630

PCT Pub. Date: Dec. 23, 2009

(65) Prior Publication Data

US 2011/0097915 A1 Apr. 28, 2011

(30) Foreign Application Priority Data

Jun. 17, 2008 (CH) ..... 925/08

(51) Int. Cl.
*H01R 29/00* (2006.01)

(52) U.S. Cl. ..... 439/172

(58) Field of Classification Search ..... 439/172, 439/173, 131

See application file for complete search history.

(56) References Cited

U.S. PATENT DOCUMENTS

| | | | | |
|---|---|---|---|---|
| 7,857,639 | B1 * | 12/2010 | Chang | 439/131 |
| 7,946,868 | B1 * | 5/2011 | Chen | 439/173 |

FOREIGN PATENT DOCUMENTS

| | | | |
|---|---|---|---|
| DE | 88 06 144 | U1 | 7/1988 |
| DE | 198 45 962 | C1 | 10/1999 |
| DE | 200 14 987 | | 10/2000 |
| EP | 0 156 076 | A | 10/1985 |
| EP | 0 616 389 | | 9/1994 |
| EP | 1 257 018 | | 5/2002 |
| GB | 2 366 087 | | 2/2002 |
| WO | WO 02/063722 | | 8/2002 |
| WO | WO 02/063723 | | 8/2002 |
| WO | WO 2007-015156 | | 2/2007 |

* cited by examiner

*Primary Examiner* — Phuong Dinh

(74) *Attorney, Agent, or Firm* — Morriss O'Bryant Compagni, P.C.

(57) ABSTRACT

The invention relates to a multi-way sliding plug (11), comprising a housing (13) and at least two plug contacts (40,50) of differing standards, which can be slid into the housing (13) into a passive position and out of the housing into an active position. Said plug contacts (40,50) each have a slide (47,57) with an operating head (15) and electrically conducting pins (41,43,45;51,53,55). The individual plug contacts (40,50) have three electrically conducting pins (41,43,45;51,53,55) on a common slider. At least two of said slides (47,57) are in a C-shape and arranged in opposition with the ends of the C-shape between the ends of the C-shape of the other slider (47,57).

15 Claims, 9 Drawing Sheets

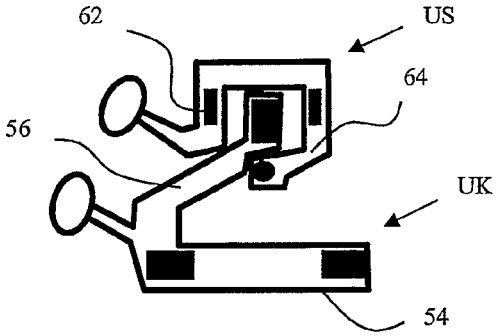
Fig. 9.1
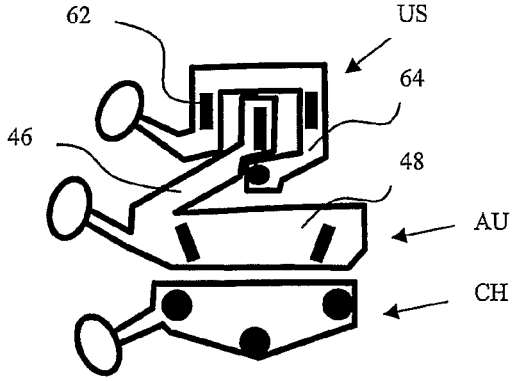
Fig. 9.2
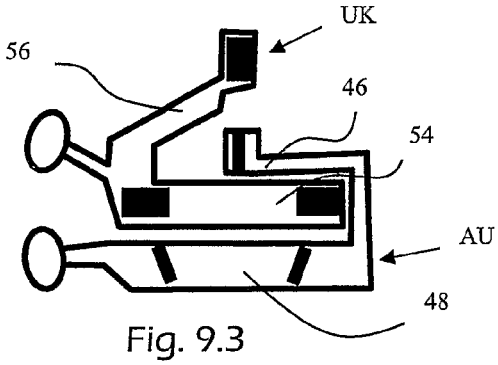
Fig. 9.3
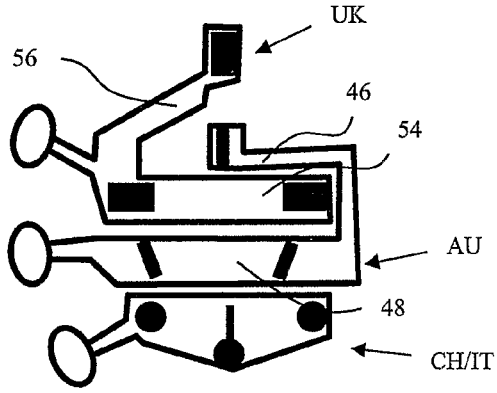
Fig. 9.4
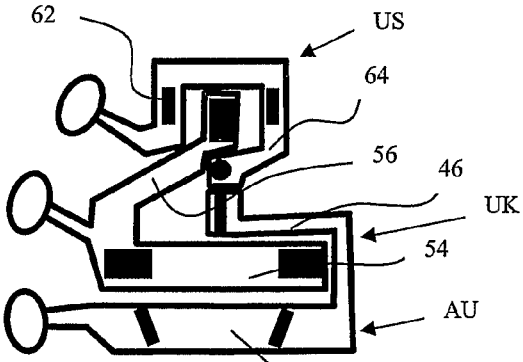
Fig. 9.5
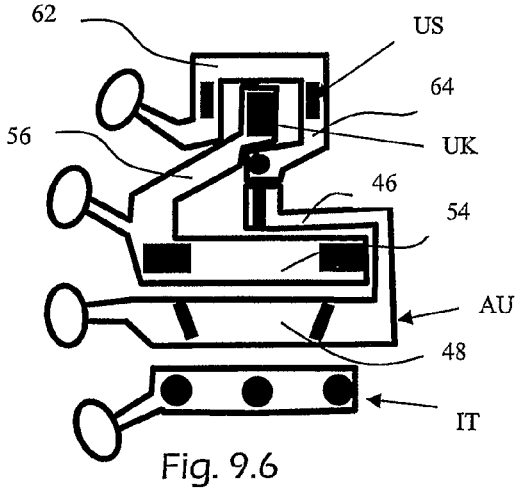
Fig. 9.6

MULTI-WAY SLIDING PLUG

CROSS-REFERENCE TO RELATED APPLICATIONS

This application claims priority to PCT Patent Application No. PCT/CH2009/000205 filed on Jun. 16, 2009 and Swiss Patent Application No. 925/08 filed on Jun. 17, 2008, the entirety of each of which is incorporated by this reference.

FIELD OF THE INVENTION

The invention relates to a multi-way plug with sliding contacts which can be moved into the housing of the multi-way plug and out of the housing of the multi-way plug. These plug contacts have a slider made of plastic with an activation head, and the pins of a plug of a respective particular mains plug standard are arranged on this slider.

STATE OF THE ART

A multi-way plug of this type is known from WO 02/063723 A2. This multi-way plug has four plug contacts of different standards each with two pins. The plug contact to British standard also has a further opener for opening the socket closure. This opener is made of one piece with the carrier part formed as a slider made of plastic. This carrier part is formed C-shaped. The activation head and opener are arranged at one end of the C, the phase pin of the UK plug contact is arranged at the other end. Between the two ends of the C-shaped carrier part is the neutral pin of the UK plug contact. An AU plug contact is arranged inside this C. On one side of the C-shaped UK carrier part, next to the opener, is a US plug contact, on the other side next to the UK pins an EU plug contact is arranged.

The disadvantage of this multi-way plug is that it is not three-pin.

It is therefore an advantage of the invention to create a multi-way plug of the type described in WO 02/063723 which has three pins. A further advantage is to provide a multi-way plug which contains the plug standards of the most important industrial countries and is constructed to be as compact as possible.

SUMMARY OF THE INVENTION

This multi-way sliding plug therefore has in the known manner a housing and at least two plug contacts of different standards. These plug contacts can be moved into the housing into a passive position and out of the housing into an active position. Each plug contact has a slider with an activation head and electrically conductive pins on the slider.

According to the invention the individual plug contacts have three electrically conductive pins arranged on a common slider. The sliders substantially have a generally C-, G-, U- or V-shape from a top view, which shapes are formed by two or more legs of the sliders. In each case, between the legs is defined a space. The sliders are arranged such that these mutually engage each with one leg in the space of the other slider. This means that in the passive position the sliders are mutually arranged with one end of the C-, G-, V- or U-shape between the ends of the C-, G-, V- or U-shape of the other slider. The arrangement of the sliders according to the invention has the advantage that the multi-way plug is very compact, and the different sliding contacts can be arranged in the smallest space. Also the number of components required to construct the plug can be kept to a minimum.

Advantageous embodiments of the invention are defined in the sub-claims. The electrically conductive pins are each formed by a phase pin, a neutral pin and a ground pin, and the sliders are each arranged such that the ground pins are directly adjacent to each other. An arrangement of this type simplifies the construction of the plug enormously.

As stated above, the sliders in top view have different forms, but as a common feature, between the pins, in particular between the phase pin and the neutral pin on one side and the ground pin on the other, there is a space in which a pin-carrying leg of an adjacent slider can engage. A slider produced in this way viewed in abstract is approximately C-shaped. Where below reference is made above all to the "C-shape" of the slider, this is in no way imitative for the present invention but includes all forms which allow the function according to the invention.

One activation head is arranged at one end of the first C-shaped slider. The other activation head is arranged between the ends of the second C-shaped slider. The second C-shaped slider is approximately Y-shaped due to the activation head. The first C-shaped slider can potentially assume the form of a question mark or an "S" due to the activation head. The term C-shaped in the context of the present invention should be merely understood to mean that the form of the slider between the first pin and the third pin forms an arc, curve or loop and that the second pin of the plug contact is arranged on this arc. By this design of the slider, a pin-carrying point of the slider of the first plug contact according to the definition above is arranged inside the loop or space in the adjacent slider when both sliders are in the passive position.

As the sliders are displaceable perpendicular to the C-shape i.e. in the axial direction of the pins, they require a sliding area with this shape. This means that the sliding areas fit in each other in the manner of U profiles each intermeshing with one leg. This arrangement of the sliding parts or sliding areas allows the three pins, arranged in a triangle, of a plug contact to cross over with the three pins of a second plug contact also arranged in a triangle. As a result the multi-way plug can be produced with low volume.

If there are three approximately C-shaped sliders, two of these engage in the loop of the central slider. The first slider and third sliders are therefore each arranged with one end between the two ends of the second C-shaped slider. Or in other words, two U-shaped sliding areas each surrounds another leg of a third sliding area and each extends with one leg between the legs of this third sliding area. The third sliding area is therefore that of the centre plug contact.

There can also be a fourth or more plug contacts.

So that the pins are not connected to live components outside the active position, each pin of a said plug contact is connected to a shorter mini-pin which is arranged close to the pin on the slider and protrudes from this. This mini-pin is plugged into an electrically conductive strip when the slider is pressed into the active position. It is withdrawn from the strip again when leaving the active position.

In order that the live strips can have a simple form, the mini-pins of different sliders are expediently aligned to each other.

The sliders must be guided. A simple guide consists of a rod which engages through a hole in the slider. At least one of the two sliders therefore has a guide opening to receive a guide rod. The guide rod is suitably part of the housing and made of one piece with this.

To secure the sliders and the pins in the active position, a locking body is provided. This cooperates with stops on the sliders. Expediently, each slider has at least one such stop. In the C-shaped slider, advantageously, next to each pin on the back of the slider, a stop is formed, which in the active position cooperates with the locking body.

Advantageously, the multi-way sliding plug has at least three, at least four or at least five plug contacts of the standards of the following countries: USA, Switzerland, Italy, Australia, Germany (grounded plug), France (grounded plug), Israel, India, South Africa. These plugs are electrically connected to the socket of a further country standard. Such plugs allow the traveller to use the electrical devices he has taken with him in the corresponding countries.

According to one embodiment the ground pins of three or four, plug contacts are arranged substantially in a straight line and directly adjacent to each other. This has the advantage that the plug is very compact. The plug contacts are provided on one side of the housing and on the opposite side a socket of a particular country standard with three socket openings is provided, which socket openings are electrically connected to the corresponding pins of the plug contacts.

The subject-matter of the present invention is also a three-pin travel plug.

BRIEF DESCRIPTION OF THE DRAWINGS

Further advantageous features arise from the description of the Figures below.

FIG. 9 shows six different possible arrangements of the sliding contacts.

DETAILED DESCRIPTION OF THE ILLUSTRATED EMBODIMENTS

Figure 1:
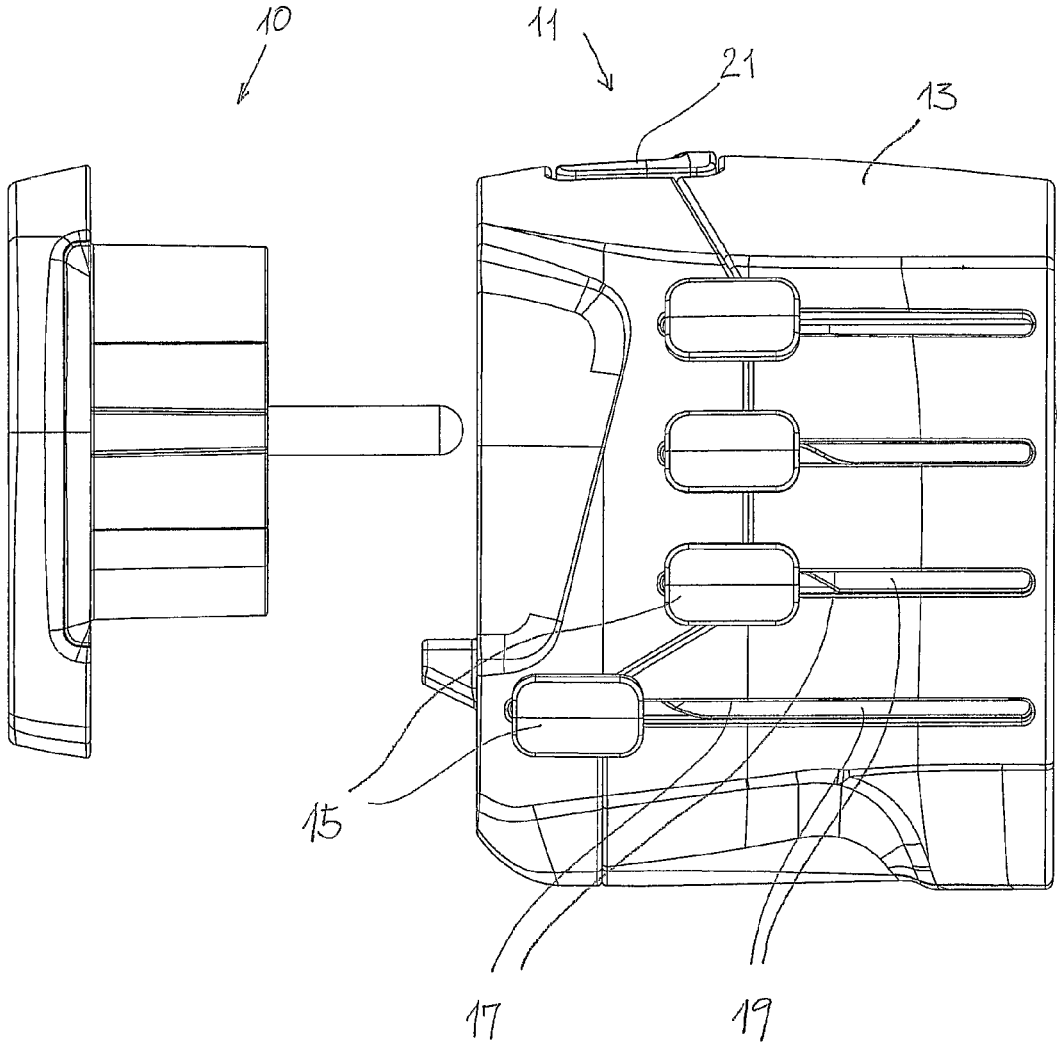
FIG. 1 shows a plug set with a multi-way plug according to the invention in a side view.

The set shown in FIG. 1 comprises a plug 10 with a multi-way socket 9 and a multi-way plug 11 with a socket 12 on the back for this plug 10. The multi-way socket can comprise a plurality of sockets of different country standards, the composition of which may vary according to area of use. The multi-way plug 11 has a housing 13 in which four sliding contacts with plug pins of different standards are accommodated. These sliding contacts each have activation heads 15, which are arranged outside the housing 13. The activation heads 15 are each connected via a continuation or bar 23 (FIG. 2) to the sliders arranged in the housing 13. Each bar 23 (FIG. 2) extends through a slot 17 in the housing 13. Plates 19 can be seen through the slots 17. These plates 19 are pushed aside by the bar 23 when a sliding contact is moved from the passive position in the housing into the active position (not shown in the Figures). In the active position the pins of the sliding contact concerned protrude from the housing so that a normal pin length is present outside the housing. The plates 19 pushed aside prevent a second sliding contact from being able to be moved into the active position at the same time.

Figure 8:
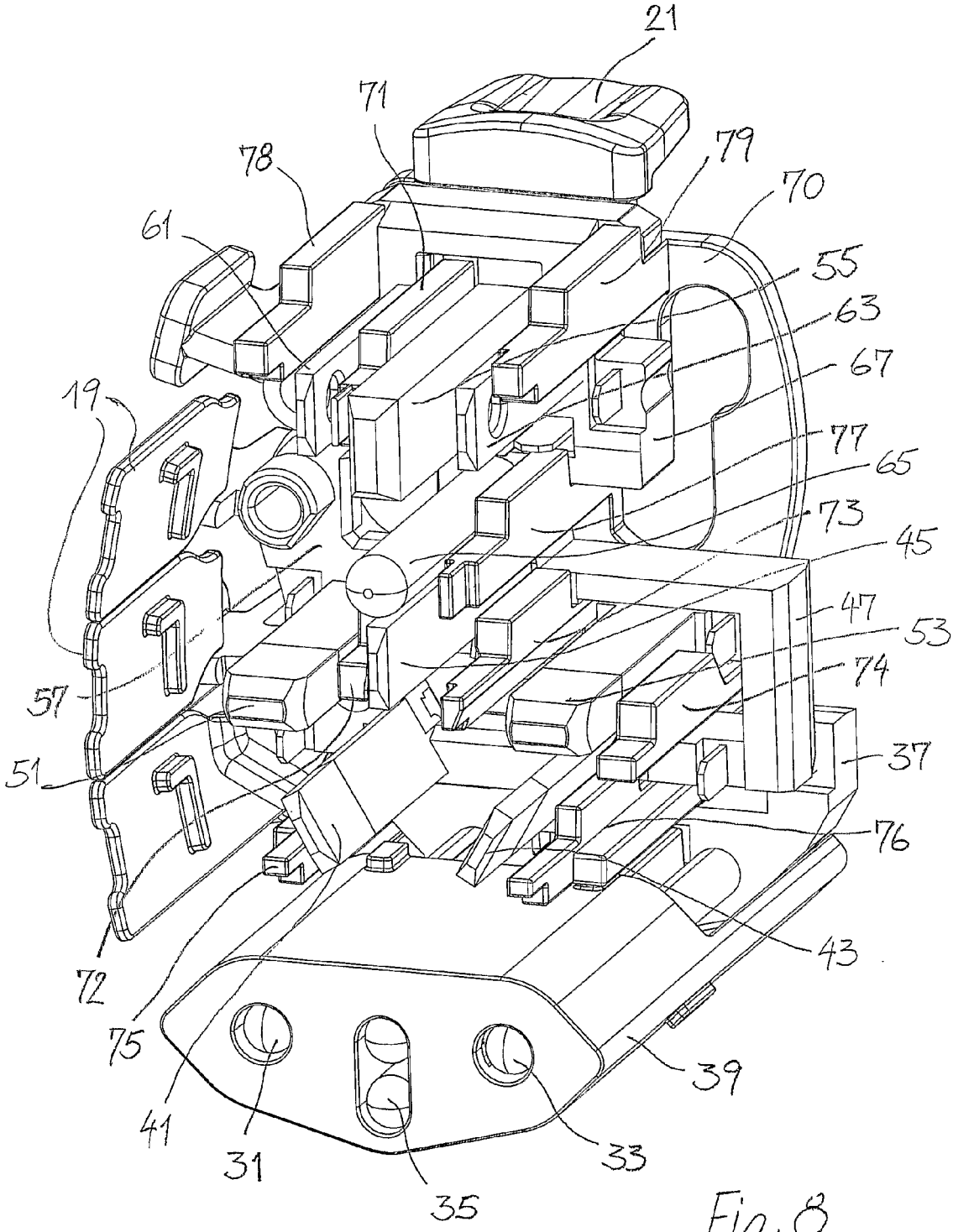
FIG. 8 shows the sliding contacts together with the locking body and plates in a perspective view.

To secure the sliding contact in the active position, a locking body is present. This has a release button 21 (FIG. 8). This release button 21 is pre-tensioned by means of a spring element in the base position. On activation of the release button 21, arms of the locking body are pushed vertically to the slide direction of the sliding contacts. In this moved release position of the release button 21, the sliding contacts are mounted so as to be freely displaceable. If the release button 21 is released, under the effect of the spring element it returns to the base position shown. In this base position the locking body locks the sliding contact which is in the active position.

Figure 2:
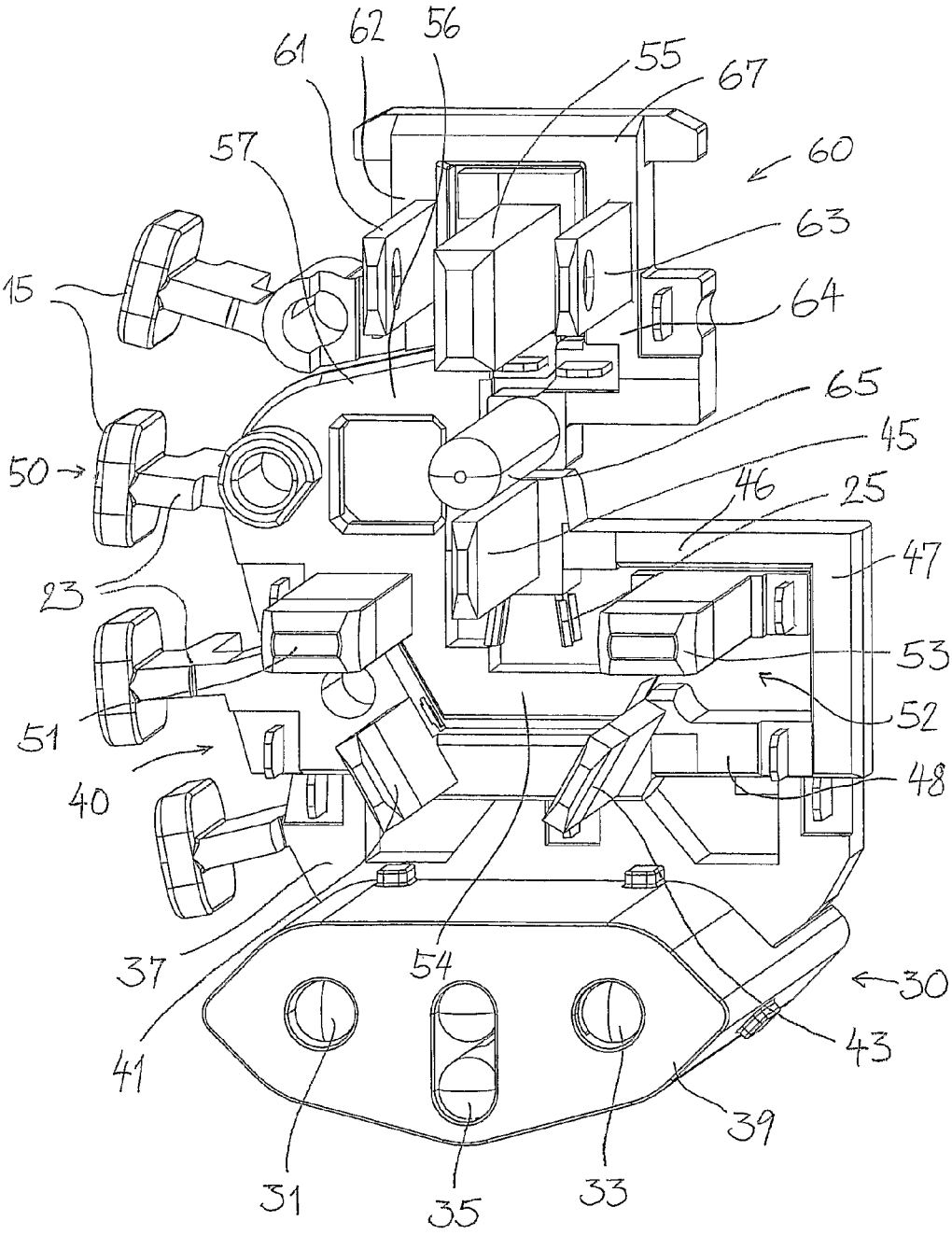
FIG. 2 shows a perspective view of the sliding contacts inside the housing.

FIG. 2 shows the sliding contacts in the passive position. A first sliding contact 30 is present for sockets of the Italian and Swiss standards. This has an insert body 39 and the three pins for the phase (pin 31), neutral (pin 33) and ground (pin 35). The ground pin 35 is shown twice, once in the triangular position for Swiss sockets and once in the linear position for Italian sockets.

A second sliding contact 40 for sockets of AU standard is arranged above this. This plug contact 40 has a slider 47 which is substantially U-shaped. This slider 47 at its distal end of a first leg 46 carries the ground pin 45 of AU standard. The oblique pins for the phase (pin 41) and neutral (pin 43) are arranged on a second leg 48 of this slider 47. Next to the phase pin 41, the activation head 15 is moulded by means of the bar 23 on the second leg 48.

A first leg 54 of slider 57 of the UK plug contact 50 protrudes into the space 52 formed by the two legs 46, 48 of the U-shaped slider 47. This leg 54 carries the two pins for phase 51 and neutral 53. The opener and ground pin 55 of UK standard is arranged on a second leg 56. The bar 23 with the activation head 15 is formed on the slider 57 in an area between the two legs 54, 56.

The slider 67 of the plug contact 60 for sockets of US standard is also approximately C- or G-shaped. The bar 23 with the activation head 15 is moulded at a first end of one leg 62. The phase pin 61 on slider 67 is arranged next to this bar 23. The slider 67 now surrounds the leg 56 of the adjacent UK slider 57, on which the ground pin 55 is arranged, with the second leg 64. The US phase pin 61 is arranged on the leg 64. In the assembled state of the multi-way sliding plug, the US phase pin 61 and the US neutral pin 63 are arranged on opposite sides of the UK ground pin 55 (FIG. 2). The slider 67 surrounds the UK ground pin 55 on the fourth side where on leg 64 it also carries the US ground pin 65. The US ground pin 65 is therefore immediately adjacent to the AU ground pin 45. Both of these ground pins 45, 65 are arranged inside the approximate C-shape of the slider 57 of the UK sliding contact 50.

Figure 3:
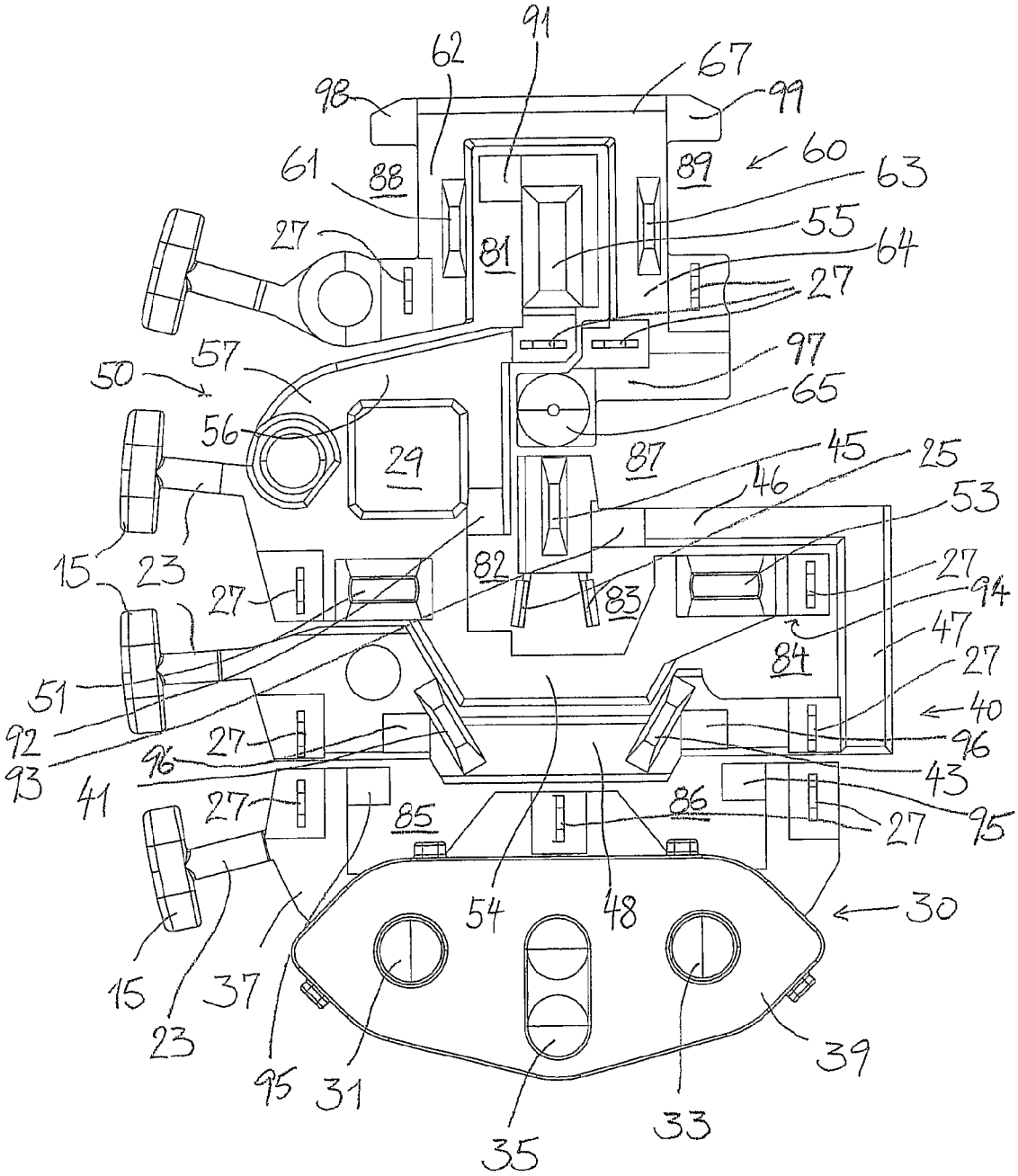
FIG. 3 shows the sliding contacts in front view.

This arrangement is shown more clearly again in FIG. 3. In this Figure the distances between the individual sliders are clearly evident. The same applies to FIG. 7. The distances show that the individual sliders 34, 47, 57, 67 are guided independently of each other. They do not touch. Although over great lengths they are only separated from each other by a minimum distance, various points arise at which the distances are greater. These points are occupied by two contact sockets for the plug 10. In the exemplary embodiment shown, the socket 12 is designed as an grounded socket, which can receive both the grounded socket of German standard and that of French standard. To this end the ground contact in the socket of the multi-way plug 11 is guaranteed in the form of a pin corresponding to French standard and in the form of two contact strips corresponding to German standard. These lie outside the sliding area for the sliding contacts. In the extension of the FR ground pin, however, a contact pin (not shown in the Figures) is arranged inside the housing 13. This contact pin is held by sliders 25 of the AU plug contact 40. It is evident that the socket 12 can be designed as a socket of any country standard in precisely the same way as the plug contacts can comprise different combinations of any country standards. For a travel plug, the socket belongs to a different standard from the plug contacts of the travel plug.

For the other pins, in the immediate vicinity of the pin, a metal mini-pin 27 is provided on the sliders. These mini-pins are in conductive contact with the associated main pin. In the active position of a plug contact, the mini-pins are electrically connected to a contact strip (not shown in the Figures), which in turn is electrically connected to the contact sockets or grounding devices of the socket 12 of the multi-way plug 11.

Between the sliders 37, 47, 57, 67 are a plurality of spaces. The function of these spaces is described below (FIGS. 3, 7 and 8):

Between the UK ground pin 55 and the US live pin 61, a first passage point 81 is formed for a first arm 71 (FIG. 8) of the locking part 70. This first arm 71 locks the UK slider 57 at the point 91 immediately next to the ground pin 55.

On the phase side of the glider 25 is a second passage point 82 for the arm 72 of the locking part 70. This second arm 72 locks the UK slider 57 at the point 92 close to its phase pin 51.

On the neutral side of the glider 25 is a third passage point 83 for the third arm 73 of the locking part 70. This third arm 73 locks the slider 47 of the AU plug contact 40 in the active position and in the passive position at the point 93 (FIG. 7) close to the AU ground pin 45.

Furthermore, on the neutral conductor side between the UK plug contact 50 and the AU plug contact 40 is a fourth passage point 84. The fourth arm 74 extends through this passage point and locks the slider 57 at the point 94. This locking takes place only in the active position of the slider 57. In its passive position the fourth arm 74 as an exception has no function.

Between the CH/IT slider 37 and the AU slider 47, there are two symmetrical passage points 85 and 86. The fifth and sixth arms 75 and 76 of the locking part 70 extend through these two passage points. These fifth and sixth arms 75, 76 lock both the CH/IT slider 37 at the points 95 and the AU slider 47 at the points 96. These points are both close to the pins for phase and neutral.

Between the sliders 47 and 67, on the neutral side of the ground pins 45 and 65 facing away from the activation head 15, is a passage point 87. The seventh arm 77 of the locking part 70 extends through this. This seventh arm 77 locks the US slider 67 at the point 97 close to the ground pin 65.

Finally, between the slider 67 of the US plug contact 60 and the housing 13 are two passage points 88 and 89. The eighth arm 78 and the ninth arm 79 of the locking part 70 extend through these. These lock the slider 67 at the points 98 and 99 close to the phase pin 61 and the neutral pin 63 respectively.

With the exception of the ground pin of the CH/IT plug contact 30, each pin is supported at a point in its immediate vicinity when the plug contact is in the active position. This gives a very stable support of the pins even when the plug contacts protruding from the housing are inserted into a socket.

The CH/IT plug contact 30 is equally well guided by the guide of the insert body 39 on the housing and adequately supported by the two arms. Therefore there is no distortion of the plug contact on insertion, nor can this accidentally be pushed back into the housing on insertion.

Figure 4:
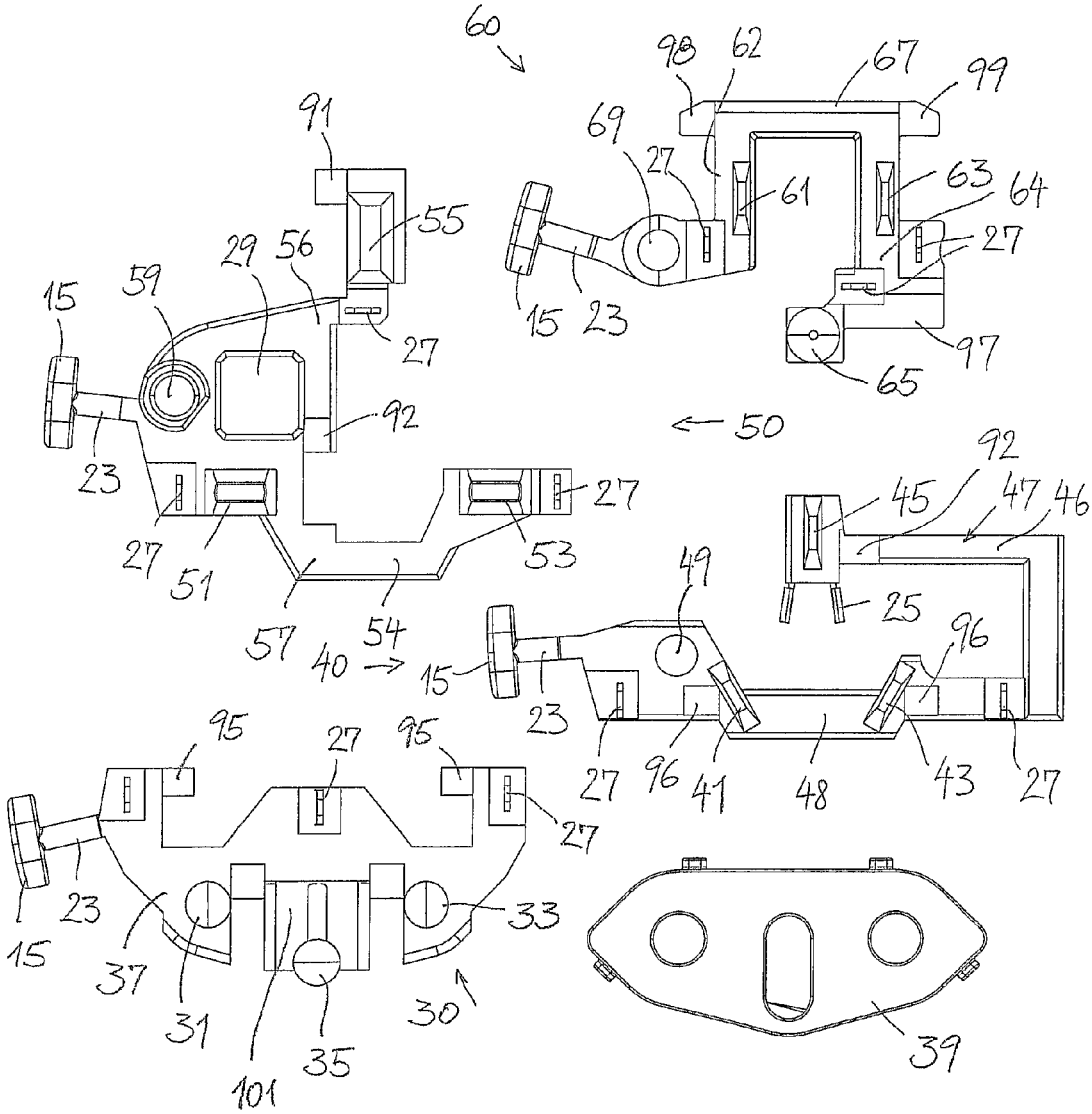
FIG. 4 shows the front view of the individual sliding contacts and the insert body of the fourth sliding contact.

The individual sliders 47, 57, 67 are guided on guide rods. For this they each have a cylindrical hole to hold these guide rods. FIG. 4 shows the four plug contacts 30, 40, 50, 60 and the insert body 39 individually. In this view and in FIG. 7, these holes are marked with reference numerals 49, 59 and 69. FIG. 4 also shows a square opening in the slider 57 with reference numeral 29. This opening 29 offers space for one of the two contact sockets for the pins of the plug 10. A second such contact socket is arranged symmetrically to the central plane through the ground pins 55, 65, 45 and 35 of the multi-way plug 11 (not shown in the Figures).

FIG. 3 shows the ground pin 35 of the CH/IT plug contact 30 in its two possible extreme positions. In the top position the ground pin 35 is arranged on a line or in a plane with the other two pins 31 and 33. In this position the plug contact can be inserted into an IT socket.

Figure 5:
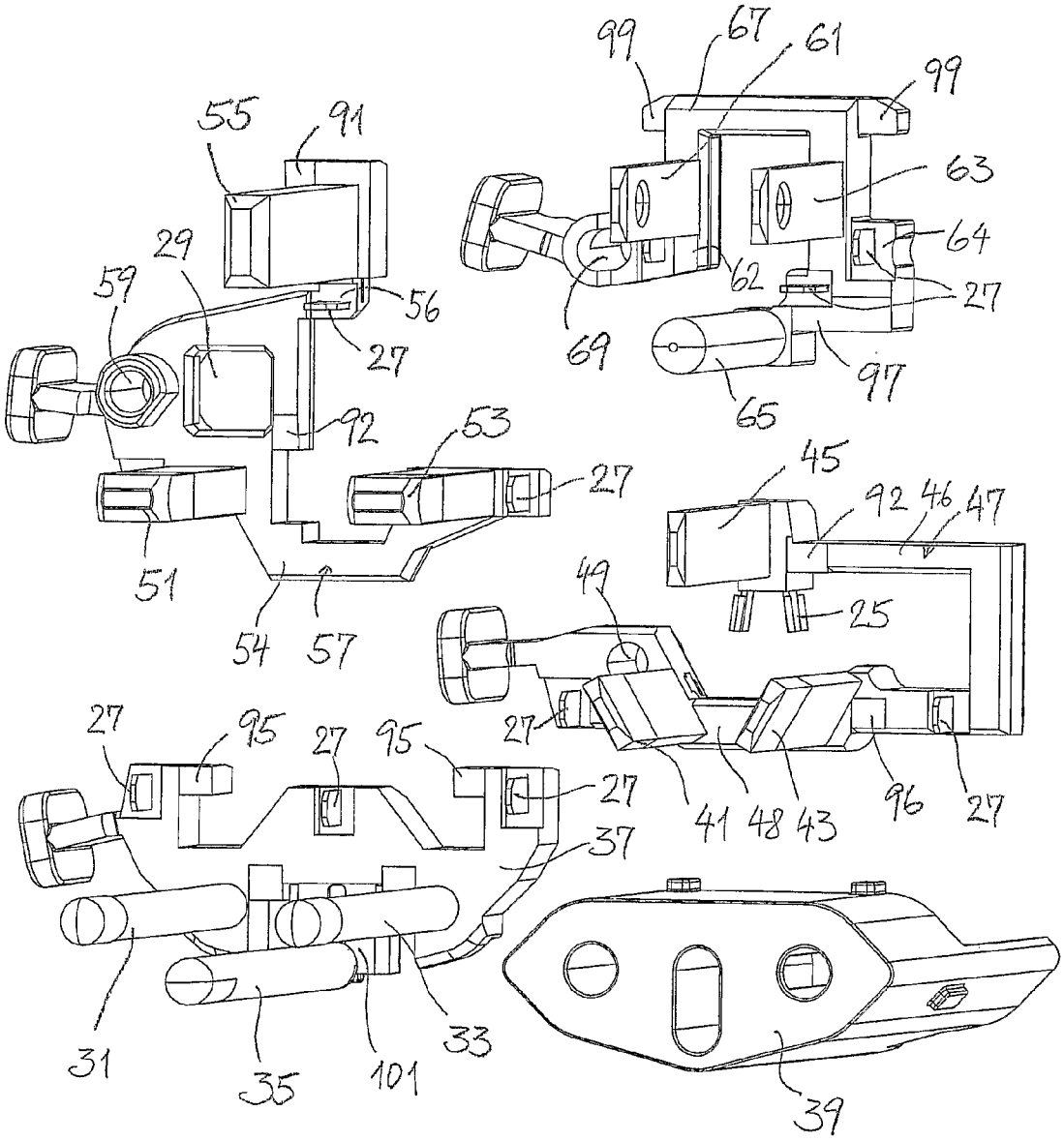
FIG. 5 shows the sliding contacts with the insert body in perspective view.
Figure 7:
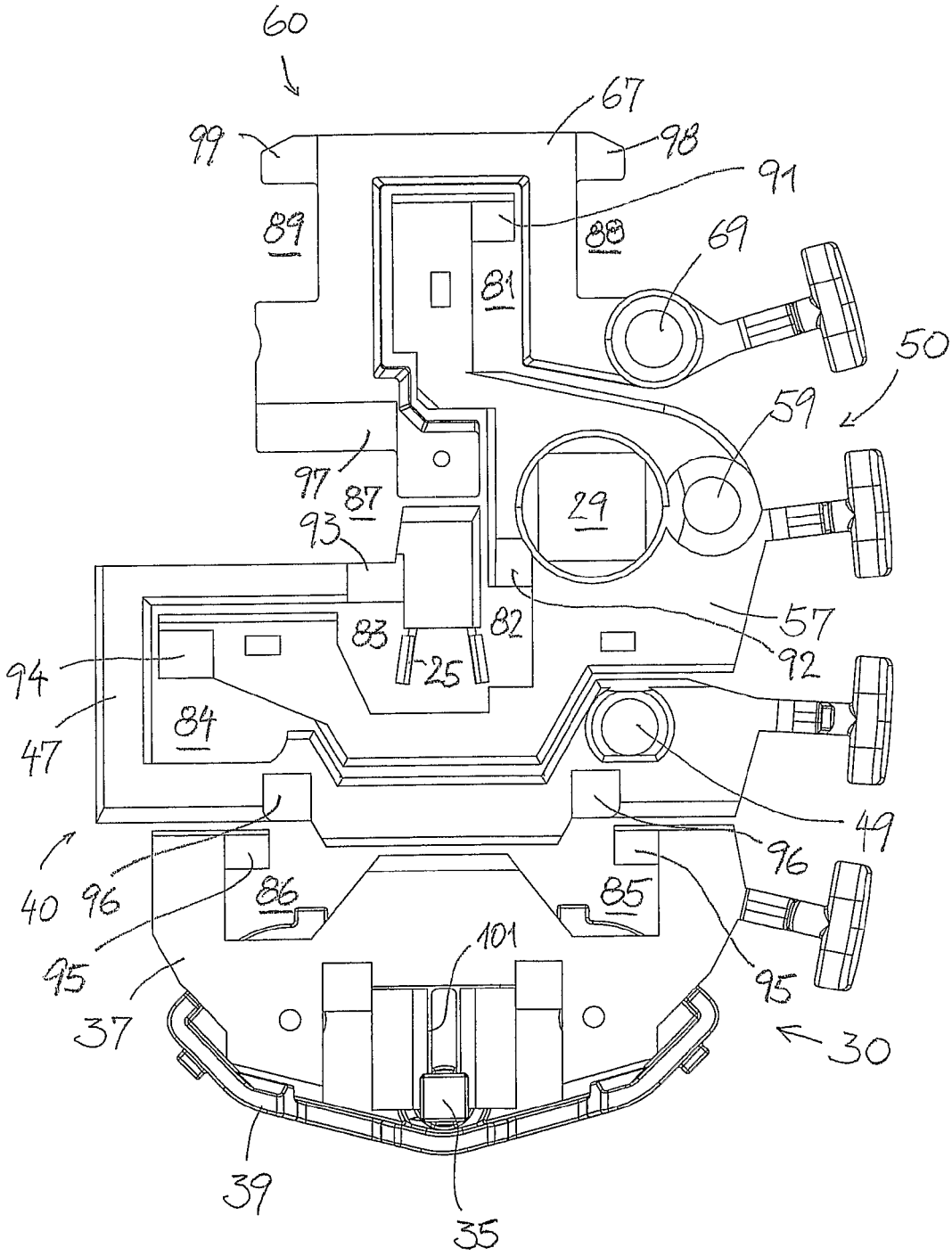
FIG. 7 shows the sliding contacts from the back.

In the position of the ground pin 35 shown in FIGS. 4, 5 and 7, the plug contact 30 can be inserted into sockets of Swiss standard. The ground pin 35 can be moved manually between the two positions for the Italian and Swiss standards. The ground pin 35 for this is guided in a slot in a metal plate 101 (FIGS. 4, 5 and 7).

Figure 6:
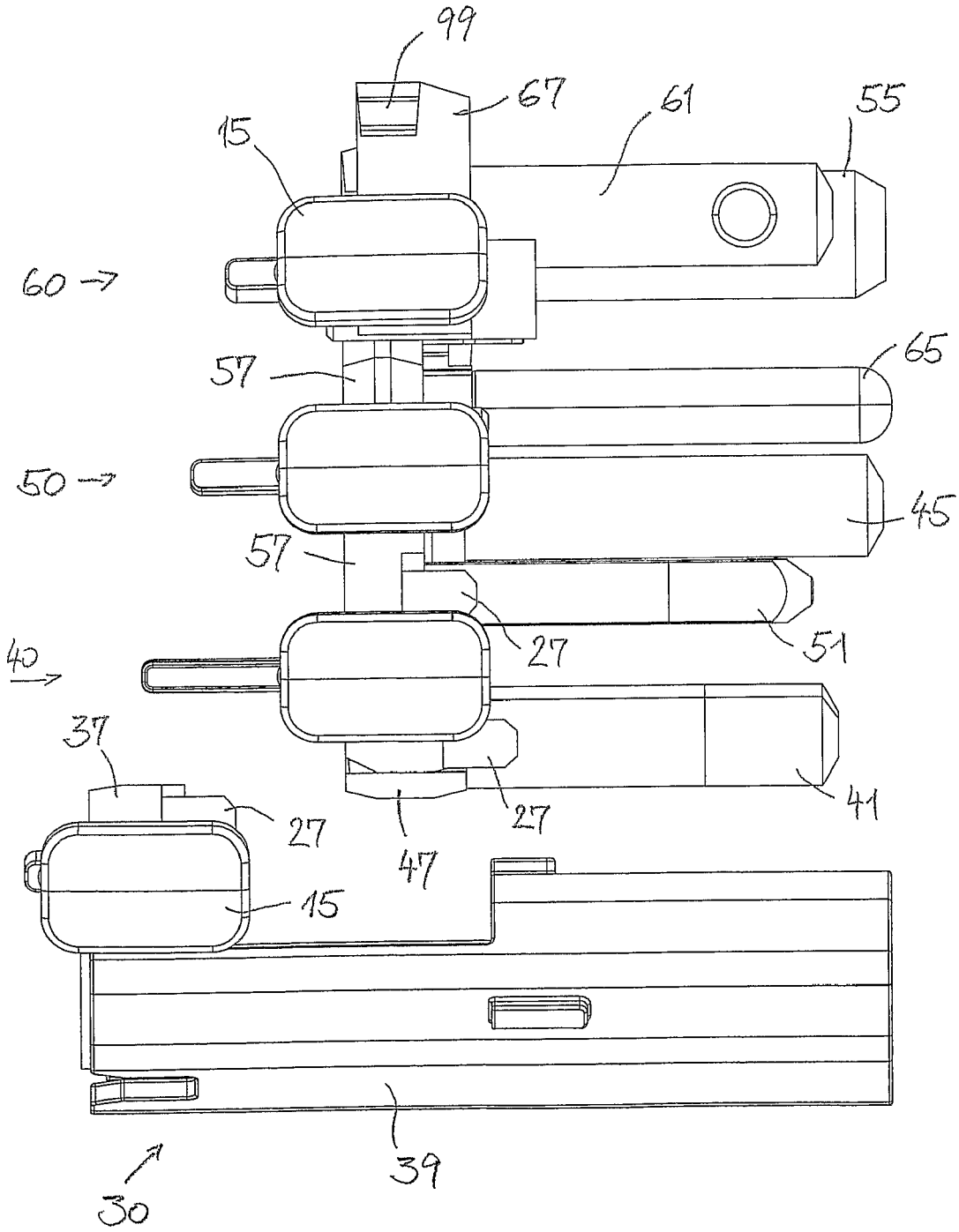
FIG. 6 shows the sliding contacts from the side.

FIG. 5 shows the same parts as in FIG. 4 but in perspective view for better understanding. FIG. 6 shows the plug contacts 30, 40, 50, 60 in a side view and in the passive position.

With the activation heads 15, each plug contact 30, 40, 50, 60 can be pushed individually to the right into the active position. The bars 23 then move in the slots 17 of the housing 13. Behind the slot 17 of an advanced plug contact, the guide rod appears and prevents reaching into the inside of the multi-way plug. The slots 17 of the plug contacts remaining in the passive position are covered by the plates 19 (FIG. 8).

The plug contacts are locked both in the active position and in the passive position. As is evident from FIG. 8, the stopped sliders are locked with the locking body 70 when they are in the passive position. The advanced plug contacts are locked by the locking body 70 in the active position. To this end, the stop points 91 to 99 are also formed on the back of the sliders. These locking points on the back are marked in FIG. 7 with the same reference numerals as on the front of the sliders 37, 47, 57, 67 in FIG. 3, 4 or 5.

FIG. 9 shows that, according to the invention, the sliding contacts can be combined with each other in different configurations. FIG. 9.1 shows only a US plug contact and a UK plug contact composed in the manner according to the invention. In FIG. 9.2, instead of the UK plug contact, an AU plug contact is shown and a CH plug contact combined with this. In FIG. 9.3, a UK and an AU plug contact are arranged engaged in each other according to the invention. In FIG. 9.4, a CH/IT plug contact is added.

FIG. 9.5 shows a combination of three sliding contacts with approximately C-, G-, V- or U-shaped sliders (but without the CH/IT plug contact). In FIG. 9.6, finally, the combination described in detail above is shown but without the CH plug contact.

A common feature of the exemplary embodiments shown in the diagrams is that a C-, G-, V- or U-shaped slider of a plug contact partly surrounds a leg of an adjacent slider of another C-, G-, V- or U-shaped plug contact. Two adjacent C-, G-, V- or U-shaped plug contacts are thus arranged relative to each other such that a leg of a first plug contact with its end engages in the space defined by the legs of the second plug contact, and conversely a leg of the second plug contact with its end engages in the space defined by the legs of the first plug contact. Each combination shown has a slider, the shape of which is approximately Y-shaped taking into account the continuation and the activation head.

To summarise, the invention can be described in that a multi-way sliding plug has at least two sliding plug contacts in a housing which can be moved out into an active position and back into a passive position in the housing. The sliding plug contacts have a slider on which the three electrically conductive contact pins are arranged. The slider of one plug contact is formed as a C-, G-, V- or U-shape, wherein an activation head is formed on one leg for advancing and retracting the plug contact. The three contact pins are arranged on the legs. A second sliding plug contact is also formed as a C-, G-, U- or V-shape, wherein for example at one end of one leg, a bar with an activation head is formed, and on the curved C-, G-, U- or V-shaped slider the three contact pins are arranged. The C-, G-, U- or V-shaped curved slider surrounds an arm of the adjacent C-, G-, U- or V-shaped slider so that a contact pin, in particular the ground contact pin, is arranged between the legs of the other C-, G-, U- or V-shaped slider.

The invention relates to a multi-way sliding plug 11 with a housing 13 and at least two plug contacts 40, 50 of different standards which can be moved into the housing 13 into a passive position and out of the housing into an active position. These plug contacts 40, 50 each have a slider 47, 57 with an activation head 15 and electrically conductive pins 41, 43, 45; 51, 53, 55. The individual plug contacts 40, 50 have three electrically conductive pins 41, 43, 45; 51, 53, 55 arranged on a common slider. At least two of the sliders 47, 57 are formed C-shaped and mutually arranged with one end of the C-shape between the ends of the C-shape of the other slider 47, 57.

The invention claimed is:

1. A multi-way sliding plug, comprising;

a housing;

at least one first plug contact of a first standard;

at least one a second plug contact of a second standard; and a plurality of sliders, each of the plurality of sliders associated with one of the at least one first plug contact and the at least one second plug contact, each having an activation head, each having a plurality of electrically conductive pins and each being movable in an axial direction from a passive position in which the plurality of electrically conductive pins are retracted in the housing to an active position in which the plurality of electrically conductive pins protrude from the housing;

the at least one first plug contact and the at least one second plug contact each having three electrically conductive pins arranged on one of the plurality of sliders; and each of the plurality of sliders having a generally C-, G-, U- or V-shape from a top view formed by at least two legs of the slider, the at least two legs defining a space therein-between with the plurality of sliders arranged such that adjacent sliders of the plurality of sliders mutually engage each other with one leg of one slider in the space of an adjacent slider.

2. The multi-way sliding plug of claim 1, wherein the electrically conductive pins comprise a phase pin, a neutral pin and a ground pin, and the plurality of sliders are arranged such that each of the ground pins are directly adjacent to one another.

3. The multi-way sliding plug of claim 1, wherein one activation head is arranged at one end of a first generally C-shaped slider and another activation head is arranged between ends of a second C-shaped slider.

4. The multi-way sliding plug of claim 1, further comprising at least three plug contacts with three generally C-, G-, U- or V-shaped sliders arranged behind each other, a first and a third slider each having a leg positioned in the space defined by a second generally C-, G-, U- or V-shaped slider.

5. The multi-way sliding plug of claim 1, further comprising a fourth plug contact of a fourth standard.

6. The multi-way sliding plug of claim 1, wherein each pin of each plug contact is conductively connected to a shorter mini-pin which protrudes from the slider proximate at least one of the plurality of electrically conductive pins.

7. The multi-way sliding plug of claim 6, wherein each mini-pin of the plurality of sliders are aligned relative to each other.

8. The multi-way sliding plug of claim 1, wherein at least one of the plurality of sliders has a guide opening through which a guide rod protrudes.

9. The multi-way sliding plug of claim 1, further comprising a stop formed on the back of each generally C-shaped slider of the plurality of sliders proximate to the electrically conductive pin thereof configured for cooperating with a locking body when the generally C-shaped slider is in the active position.

10. The multi-way sliding plug of claim 1, further comprising at least three plug contacts of the standards selected from the group comprising the following countries: USA, Switzerland, Italy, Australia, Germany (grounded plug), France (grounded plug), Israel, India, and South Africa.

11. The multi-way sliding plug of claim 1, wherein each of the at least one first and at least one second plug contacts include a grounded pin, at least three of the grounded pins arranged substantially in a straight line.

12. The multi-way sliding plug of claim 1, wherein each of the at least one first and at least one second plug contacts are provided on one side of the housing, and wherein, on an opposite side, a socket of a particular country standard with three socket openings is provided, the socket openings being electrically connected to corresponding pins of the at least one first and at least one second plug contacts.

13. A three-pin travel plug, comprising:

a housing;

at least one first plug contact of a first standard and a second plug contact of a second standard, first and second plug contacts each have a slider with an activation head and a plurality of electrically conductive pins each slider being movable in an axial direction from a passive position in which the plurality of electrically conductive pins are retracted in the housing to an active position in which the plurality of electrically conductive pins protrude from the housing;

each plug contact having three electrically conductive pins arranged on one slider; and each slider having a generally C-, G-, U- or V-shape from a top view formed by two or more legs of the sliders, between which legs is defined a space, each slider arranged such that they mutually engage an adjacent slider with one leg of one slider in the space defined by the legs of the adjacent slider.

14. A multi-way sliding plug, comprising;

a housing;

at least two plug contacts, each of a different standard movable from a passive position in the housing to an active position out of the housing a plurality of sliders, each slider coupled to one of the at least two plug contacts and each slider having at least two ends defining a space therein between for receiving an end from an adjacent slider;

a plurality of activation heads, each activation head coupled to one of the plurality of sliders; and at least three electrically conductive pins coupled to each of the plurality of sliders.

15. The multi-way sliding plug of claim 14, wherein at least two sliders of the plurality of sliders have a generally C-shaped configuration with one end of one C-shaped slider positioned between the ends of the other C-shaped slider.

* * * * *